US007727617B2

(12) United States Patent
Lee et al.

(10) Patent No.: US 7,727,617 B2
(45) Date of Patent: Jun. 1, 2010

(54) THERMAL MASS TRANSFER IMAGED RETROREFLECTIVE SHEETING

(75) Inventors: Jennifer L. Lee, Eagan, MN (US); Mark W. Leverty, Lakeland, MN (US); Scott A. Boyd, White Bear Lake, MN (US); Eugene H. Carlson, Apple Valley, MN (US); Lisa Flatt Nelson, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1015 days.

(21) Appl. No.: 11/425,615

(22) Filed: Jun. 21, 2006

(65) Prior Publication Data

US 2006/0292353 A1 Dec. 28, 2006

Related U.S. Application Data

(60) Provisional application No. 60/693,021, filed on Jun. 22, 2005.

(51) Int. Cl.
*B41M 5/00* (2006.01)
*B44C 1/17* (2006.01)
*G03G 7/00* (2006.01)

(52) U.S. Cl. ..... 428/195.1; 428/480; 428/500; 428/913; 428/913.3; 359/529; 359/530; 359/534; 359/536; 359/542

(58) Field of Classification Search ..... 428/195.1, 428/480, 500, 913, 913.3; 359/529, 530, 359/534–542
See application file for complete search history.

(56) References Cited

U.S. PATENT DOCUMENTS

| | | | |
|---|---|---|---|
| 5,508,105 | A | 4/1996 | Orensteen et al. |
| 5,837,347 | A | 11/1998 | Marecki |
| 5,861,211 | A | 1/1999 | Thakkar et al. |
| 5,940,212 | A | 8/1999 | Johnson et al. |
| 6,066,384 | A | 5/2000 | Crandall |
| 6,190,757 | B1 | 2/2001 | Nelson et al. |
| 6,706,341 | B1 | 3/2004 | Schnitzel et al. |
| 6,726,982 | B2 | 4/2004 | Christian et al. |
| 6,730,376 | B2 | 5/2004 | Stofko et al. |
| 2008/0118638 | A1 | 5/2008 | Lee et al. |

FOREIGN PATENT DOCUMENTS

| | | |
|---|---|---|
| EP | 0778801 | 10/1998 |
| WO | WO 94/19769 | 9/1994 |
| WO | WO 95/12515 | 5/1995 |

OTHER PUBLICATIONS

Formulator Resources, Millennium Chemicals, introduction to light scattering and opacity, pp. 1-4.

*Primary Examiner*—Betelhem Shewareged
(74) *Attorney, Agent, or Firm*—Sandra K. Nowak

(57) ABSTRACT

Retroreflective sheeting is described comprising a viewing surface and a non-viewing surface and a thermal mass transferred image disposed in the optical path of the viewing surface wherein the thermal mass transferred image comprises a homogeneous unreactive thermoplastic composition. In one embodiment, the unreactive thermoplastic composition comprises at least one acrylic resin and at least one colorant, wherein the composition has less than 3 wt-% of components that are opaque at ambient temperature. The percent maximum diffuse luminous transmittance to total luminous transmittance of the composition is less than 50%.

19 Claims, 2 Drawing Sheets

THERMAL MASS TRANSFER IMAGED RETROREFLECTIVE SHEETING

RELATED APPLICATIONS

This application claim priority to U.S. patent application Ser. No. 60/693,021 filed Jun. 22, 2005.

BACKGROUND

Thermal printing is a term broadly used to describe several different families of technology for making an image on a substrate. Those technologies include hot stamping, direct thermal printing, dye diffusion printing and thermal mass transfer printing.

Hot stamping is a mechanical printing system in which a pattern is stamped or embossed through a ribbon onto a substrate, such as disclosed in WO95/12515. The pattern is imprinted onto the substrate by the application of heat and pressure to the pattern. A colored material on the ribbon, such as a dye or ink, is thereby transferred to the substrate where the pattern has been applied. The substrate can be preheated prior to imprinting the pattern on the substrate. Since the stamp pattern is fixed, hot stamping cannot easily be used to apply variable indicia or images on the substrate. Consequently, hot stamping is typically not useful for printing variable information, such as printing sheets used to make license plates.

Direct thermal printing was commonly used in older style facsimile machines. Those systems required a special substrate that includes a colorant so that localized heat can change the color of the paper in the specified location. In operation, the substrate is conveyed past an arrangement of tiny individual heating elements, or pixels, that selectively heat (or not heat) the substrate. Wherever the pixels heat the substrate, the substrate changes color. By coordinating the heating action of the pixels, images such as letters and numbers can form on the substrate. However, the substrate can change color unintentionally such as when exposed to light, heat or mechanical forces.

Dye diffusion thermal transfer involves the transport of dye by the physical process of diffusion from a dye donor layer into a dye receiving substrate. Typically, the surface of the film to be printed further comprises a dye receptive layer in order to promote such diffusion. Similar to direct thermal printing, the ribbon containing the dye and the substrate is conveyed past an arrangement of heating elements (pixels) that selectively heat the ribbon. Wherever the pixels heat the ribbon, solid dye liquefies and transfers to the substrate via diffusion. Some known dyes chemically interact with the substrate after being transferred by dye diffusion. Color formation in the substrate may depend on a chemical reaction. Consequently, the color density may not fully develop if the thermal energy (the temperature attained or the time elapsed) is too low. Thus, color development using dye diffusion is often augmented by a post-printing step such as thermal fusing.

Thermal mass transfer printing, also known as thermal transfer printing, non-impact printing, thermal graphic printing and thermography, has become popular and commercially successful for forming characters on a substrate. Like hot stamping, heat and pressure are used to transfer an image from a ribbon onto a substrate. Like direct thermal printing and dye diffusion printing, pixel heaters selectively heat the ribbon to transfer the colorant to the substrate. However, the colorant on the ribbon used for thermal mass transfer printing comprises a polymeric binder having a wax base, resin base or mixture thereof typically containing pigments and/or dyes. During printing, the ribbon is positioned between the print head and the exposed surface of the polymer film. The print head contacts the thermal mass transfer ribbon and the pixel heater heats the ribbon such that it transfers the colorant from the ribbon to the film as the film passes through the thermal mass transfer printer.

Thermal mass transfer has been described for imaging retroreflective sheeting. See for example WO 94/19769 and U.S. Pat. No. 5,508,105.

U.S. Pat. No. 6,730,376 describes a photocurable thermally transferable composition containing a multifunctional monomer that is substantially non-liquid at room temperature and a thermoplastic binder. The composition is suitable to use in thermal transfer ribbons. After thermal transfer, the compositions are photocured to provide a durable, weatherable image, on a graphic article.

U.S. Pat. No. 6,726,982 describes thermal transfer articles comprising a carrier, optional release layer, a color layer releasably adhered thereto, and optionally an adherence layer on the bottom side of the color layer. The transfer articles are radiation crosslinked after transfer such that a durable image is formed.

U.S. Pat. No. 6,190,757 describes coatable thermal mass transfer precursor compositions comprising a polyalkylene binder precursor, an acrylic binder precursor, an effective amount of pigment and a diluent (preferably water). As described at column 4, lines 54-56, the polyalkylene latex and acrylic latex binder precursors are immiscible. The acrylic latex binder forms islands in the film formed by the polyalkylene binder.

SUMMARY OF THE INVENTION

Although various thermal mass transfer compositions suitable for imaging retroreflective sheeting have been described, industry would find advantage in alternative compositions. For example, industry would find advantage in durable compositions that do not necessitate radiation curing. Industry would also find advantage in imaged retroreflective sheeting having improved transparency resulting in improved retroreflected brightness.

Presently described is retroreflective sheeting comprising a viewing surface and a non-viewing surface and a thermal mass transferred image disposed in the optical path of the viewing surface wherein the thermal mass transferred image comprises a homogeneous unreactive thermoplastic composition.

In one embodiment, the unreactive thermoplastic composition comprises at least one acrylic resin and at least one colorant, wherein the composition has less than 3 wt-% of components that are opaque at ambient temperature. The percent maximum diffuse luminous transmittance to total luminous transmittance of the composition is less than 50%.

In another embodiment, the thermal mass transferred image comprises a thermoplastic composition comprising at least 50 wt-% of one or more unreactive acrylic resins, optionally up to about 30 wt-% of a second thermoplastic resin, and a colorant. The second thermoplastic resin is preferably selected from an acrylic resin, a polyvinyl resin, a polyester, a polyurethane, and mixtures thereof.

In another embodiment, the unreactive thermoplastic composition comprises at least one acrylic resin having an average molecular weight of at least 80,000 g/mole and a colorant.

BRIEF DESCRIPTION OF THE DRAWINGS

The invention will be further explained with reference to the drawing, wherein.

DETAILED DESCRIPTION

Presently described are retroreflective sheeting articles comprising a thermal mass transfer image.

Retroreflective sheeting articles are known. Such articles are commonly employed in traffic signage and licenses as well as other traffic warning items such as roll-up signs; cone, post and barrel wrap sheeting; barricade sheeting; as well pavement marking tapes and sheeting.

Figure 1:
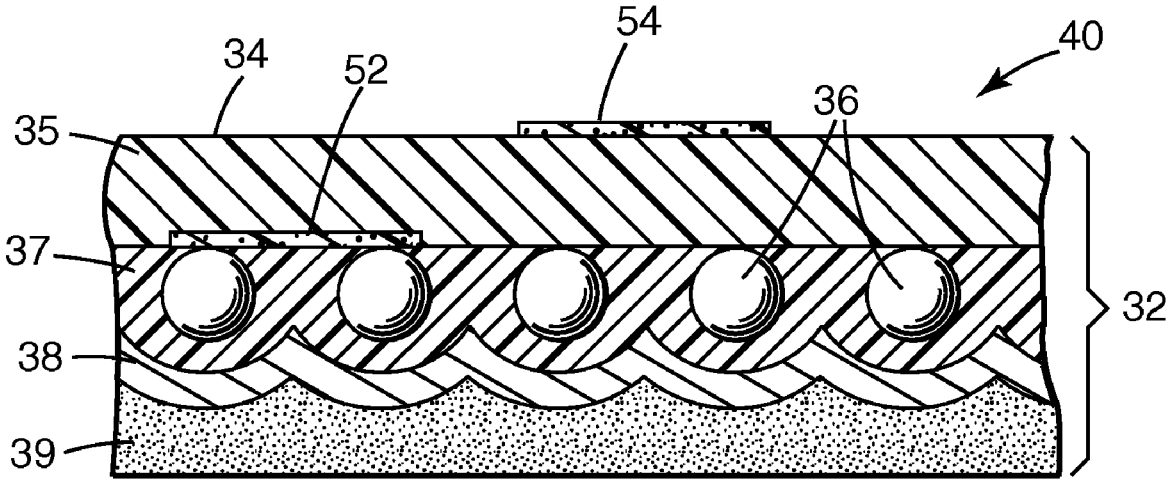
FIG. 1 is a schematic cross-sectional view of an enclosed-lens retroreflective article having a thermal mass transferred image.

FIG. 1 is an illustrative embodiment. Article 40 comprises retroreflective sheeting 32 and thermal mass transferred image 52 and 54. Front surface 34 is the exposed surface of image receiving layer 35. Retroreflective sheeting substrate 32 may comprise a monolayer of glass or ceramic microsphere retroreflective elements 36 embedded in binder layer 37 with underlying reflecting layer 38. Such retroreflective base sheets are well known and disclosed in, for example, U.S. Pat. No. 4,664,966 (Bailey et al.) and U.S. Pat. No. 4,983,436 (Bailey et al.). Illustrative examples of materials used in binder layer 37 include polyvinyl butyral and polyurethane alkyd. Retroreflective article 30 also preferably comprises optional adhesive layer 39 that may have an optional liner thereon (not illustrated).

Figure 2:
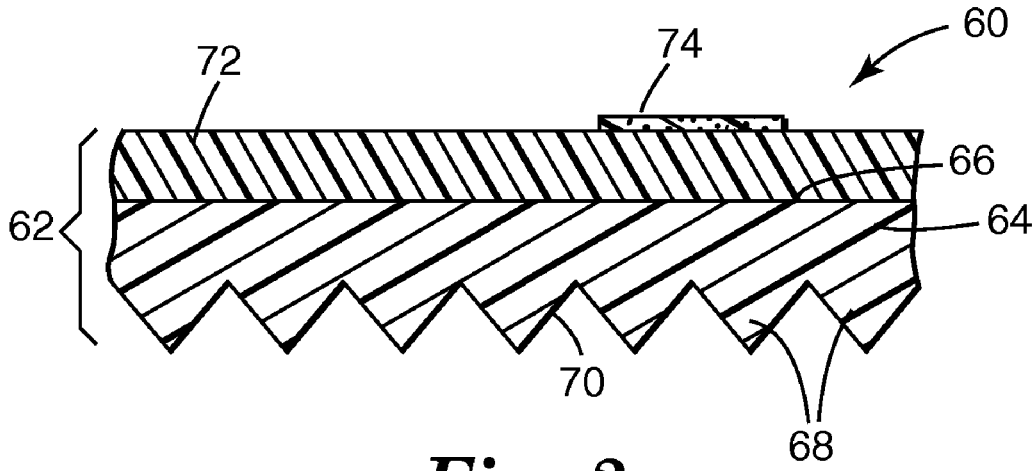
FIG. 2 is a schematic cross-sectional view of a cube corner retroreflective article having a thermal mass transferred image.

Another embodiment is illustrated in FIG. 2 wherein article 60 comprises retroreflective substrate 62 and thermal mass transferred image 74 on the image receiving layer or front surface of cover sheet 72. Substrate 62 comprises cube-corner type retroreflective sheeting 64 with flat front surface 66 and a plurality of cube-corner elements 68 protruding from rear surface 70 thereof. Optional abrasion resistant cover sheet 72 is disposed on the upper surface of sheeting 64. Illustrative cube-corner type retroreflective sheetings are disclosed in U.S. Pat. No. 3,712,706 (Stamm), U.S. Pat. No. 4,243,618 (Van Arnam), U.S. Pat. No. 4,349,598 (White), U.S. Pat. No. 4,588,258 (Hoopman), U.S. Pat. No. 4,775,219 (Appledorn et al.), and U.S. Pat. No. 4,895,428 (Nelson et al.) all of which are incorporated by reference herein. Typically, cube-corner elements 68 will be encapsulated using a sealing film (not shown), such as is disclosed in U.S. Pat. No. 4,025,159 (McGrath) previously incorporated by reference.

Retroreflective sheeting is commercially available from 3M Company, St. Paul, Minn. under the trade designations "3M" and "Diamond Grade".

The thermal transferred image is typically provided on an exposed surface of an optically complete retroreflective sheeting, such as 54 of FIG. 1 and 74 of FIG. 2. Alternatively, the thermal mass transferred image may be provided on an optically incomplete construction that needs an additional component in order to be retroreflective (e.g. 52 of FIG. 1). Further, a cover film or topcoat may optionally be applied over 54 or 74. Accordingly, in some instances the thermal mass transferred image is buried beneath the exposed surface layer (e.g. such as 52 of FIG. 1). The retroreflective article may have a combination of at least one exposed thermal mass transferred image and at least one unexposed thermal mass transferred image, such as shown in FIG. 1.

Regardless of whether the retroreflective sheeting comprises microsphere or cube corner elements, the thermal transferred image is provided in the optical path of the retroreflective base sheet, meaning that the graphic image lies within the path taken by incident light that is retroreflected by the resultant article. Accordingly, the thermal transferred image is disposed between the retroreflective elements (e.g. 68 or 36 in combination with 38) and the viewing surface of the sheeting.

The image receiving layer (e.g. 35, 37, 64, 72 of FIG. 1-2) may comprise various polymeric materials including for example acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Other image reception layers comprise an acid- or acid/acrylate modified ethylene vinyl acetate resin, as disclosed in U.S. Pat. No. 5,721,086 (Emslander et al.). The image receiving layer may comprise a water-borne acrylic polymer topcoat. The dried and optionally cured topcoat may have an elastic modulus when tested with nanoindentation ranging from 0.2 GPa to 2.0 Gpa, as described in Published U.S. Patent Application No. 2004/0018344; incorporated herein by reference. Further the retroreflective sheeting or top film may be surface treated (e.g. corona) and/or comprise a primer which may be disposed between the substrate and image reception layer.

The thickness of the thermally transferred layer will vary. Thicker transfer layers typically result in longer exposure times of the ribbon and underlying retroreflective sheeting to the heat source and/or higher heat source temperatures. Layers that are too thick can undesirably increase the thermal conductivity of the thermally transferable article such that graphic resolution is impaired. The thermal mass transferred image typically has a thickness of 1 to 5 micrometers. However, the thickness may range as high 25 micrometers (1 mil).

Presently described are thermal mass transfer compositions and retroreflective sheeting articles imaged with such compositions. The thermal mass transfer compositions described herein are unreactive. The thermal mass transfer compositions are substantially free of ingredients that are crosslinkable (e.g. upon exposure to actinic radiation).

The formation of a visibly homogenous blend (the blend appears homogeneous and uniform to the eye) is important, as visibly non-homogenous polymer blends will not form a continuously transparent film as is necessary for the representation of retroreflective colors. High transparency is attained by maintaining similarity between the refractive indexes of all components of the composition of the invention. In addition the thermal mass transfer composition contain only small concentrations or more preferably is free of components that are opaque at ambient temperature such as inorganic fillers and waxes. The concentration of opaque components in the solid thermal transfer composition is typically less than 3 wt-% and preferably less than 1 wt-%.

The terms "opacity" and "opaque" are used in various contexts to describe something that is not transparent. Two factors give rise to the opacifying properties of a pigmented film, i.e. the scattering and absorption of light. Colored pigments preferentially absorb light in a specific portion of the spectrum. The observed color is a function of the portion of the spectrum in which the light is reflected. On the other hand light bends and is scattered because of its different speeds in different media as a result of differences in refractive indices. It is appreciated that inorganic fillers and waxes contribute to opacity primarily in view of their light scattering properties.

One way of detecting the presence of light scattering components is diffuse luminous transmittance, as determined according to the test method described in the examples. The retroreflective sheeting is preferably imaged with a thermal mass transfer composition that has a percent maximum diffuse luminous transmittance to total luminous transmittance of less than 50%. The percent maximum diffuse luminous transmittance to total luminous transmittance is more preferably less than 40%, 30%, or 20%.

"Durable for outdoor usage" refers to the ability of the article to withstand temperature extremes, exposure to moisture ranging from dew to rainstorms, and colorfast stability under sunlight's ultraviolet radiation. The threshold of durability is dependent upon the conditions to which the article is likely to be exposed and thus can vary. At minimum, however, the articles of the present invention do not delaminate or deteriorate when submersed in ambient temperature (25° C.) water for 24 hours, nor when exposed to temperatures (wet or dry) ranging from about −40° C. to about 140° F. (60° C.).

In the case of signage for traffic control, the articles are preferably sufficiently durable such that the articles are able to withstand at least one year and more preferably at least three years of weathering. This can be determined with ASTM D4956-05 Standard Specification of Retroreflective Sheeting for Traffic Control that describes the application-dependant minimum performance requirements, both initially and following accelerated outdoor weathering, of several types of retroreflective sheeting. Initially, the reflective substrate meets or exceeds the minimum coefficient of retroreflection. For Type I white sheetings ("engineering grade"), the minimum coefficient of retroreflection is 70 cd/fc/ft$^2$ at an observation angle of 0.2° and an entrance angle of −4°, whereas for Type III white sheetings ("high intensity") the minimum coefficient of retroreflection is 250 cd/fc/ft$^2$ at an observation angle of 0.2° and an entrance angle of −4°. In addition, minimum specifications for shrinkage, flexibility adhesion, impact resistance and gloss are preferably met. After accelerated outdoor weathering for 12, 24, or 36 months, depending on the sheeting type and application, the retroreflective sheeting preferably shows no appreciable cracking, scaling, pitting, blistering, edge lifting or curling, or more than 0.8 millimeters shrinkage or expansion following the specified testing period. In addition, the weathered retroreflective articles preferably exhibit at least the minimum coefficient of retroreflection and colorfastness. For example, Type I "engineering grade" retroreflective sheeting intended for permanent signing applications retains at least 50% of the initial minimum coefficient of retroreflection after 24 months of outdoor weathering and Type III high intensity type retroreflective sheeting intended for permanent signing applications retains at least 80% of the initial minimum coefficient of retroreflection following 36 months of outdoor weathering in order to meet the specification. The coefficient of retroreflection values can be up to 30% lower initially and at most 50% lower following outdoor weathering.

The thermal transfer composition comprises one or more unreactive thermoplastic acrylic polymers and at least one colorant. In at least some embodiments, the thermoplastic composition comprises at least 50 wt-% of one or more unreactive thermoplastic acrylic polymers. The thermal transfer composition typically comprises at least 55 wt-% to 60 wt-% and no more than about 80 wt-% unreactive thermoplastic acrylic polymer.

In general, acrylic resins are prepared from various (meth) acrylate monomers such as methyl methacrylate (MMA), ethyl acrylate (EA), butyl acrylate(BA), butyl methacrylate (BMA), n-butyl methacrylate (n-BMA) isobutylmethacrylate (IBMA), ethylmethacrylate (EMA), etc. alone or in combination with each other. Exemplary acrylic resins include those commercially available from Rohm and Haas, Co., Philadelphia, Pa. under the trade designation "Paraloid" and from Lucite International, Inc., Cordova, Tenn. under the trade designation "Elvacite" resins. Other suitable polyacrylic materials include those from S. C. Johnson, Racine, Wis. under the trade designation "Joncryl" acrylics.

The unreactive thermoplastic acrylic polymer may optionally be combined with a second modifying unreactive thermoplastic polymer. The modifying polymer is compatible (i.e. miscible) with the unreactive thermoplastic polymer resulting in a homogenous mixture. The modifying polymer may be employed to adjust the Tg of the acrylic polymer. The modifying polymer may also reduce the viscosity of the mixture including the acrylic polymer. The amount of modifying polymer may ranges from about 5 wt-% to about 30 wt-%.

In some embodiments, the weight average molecular weight of the unreactive thermoplastic polymer (i.e. acrylic polymer and optional modifying polymer) is chosen to maximize the durability in combination with providing a composition that can provide a sufficiently low enough viscosity when dispersed in (e.g. organic) solvent to be coated by conventional techniques onto a carrier to be formed into a thermal mass transfer ribbon.

The weight average molecular weight (Mw) of the unreactive thermoplastic (e.g. acrylic or acrylic blend) polymer as measured by Gel Permeation Chromotography (GPC) is typically at least 15,000 g/mole, yet typically less than 200,000 g/mole. Preferably the base polymer has an Mw of less than 165,000 g/mole, more preferably less than about 150,000 g/mole. In at least some embodiments the Mw of the acrylic resin is at least 80,000 g/mole.

In the case wherein the unreactive thermoplastic polymer comprises a blend of two or more polymeric species, the Mw of the blend, for purposes of the present invention, refers to the Mw calculated in accordance with the following equation:

Mw (blend)=$\Sigma w_x M_x$; wherein $M_x$ is the weight average molecular weight of each polymeric species and $w_x$ is the weight fraction of such polymeric species with respect to the blend.

Accordingly, in the case of a bimodal blend, the Mw of the blend is typically a median value between the peaks.

In addition, the unreactive thermoplastic polymer of the thermal mass transfer composition has a glass transition temperature (Tg), as measured according to Differential Scanning Colorimetry (DSC) from about 30° C. to about 110° C. and preferably from about 50° C. to about 100° C. At a Tg of less than about 30° C., dirt can accumulate on the imaged surface. At a Tg of greater than about 110° C., the thermal mass transferred image is typically brittle such that the primer coating is susceptible to cracking upon being flexed or creased. However, relatively high Tg polymers can usefully be employed to at least some extent by combination with a compatible modifying polymer having a lower Tg.

In the case of unreactive thermoplastic polymer compositions comprising two or more polymers wherein each has a distinct peak, the Tg of the blend, for purposes of the present invention, refers to the Tg calculated in accordance with the following equation:

$1/Tg\ (blend)=\Sigma w_x/Tg_x$; wherein $Tg_x$ is the Tg of each polymeric species and $w_x$ is the weight fraction of such polymeric species with respect to the blend. Tg values in the above equation are measured in degrees Kelvin.

The molecular weight of the modifying polymer may be less than 50,000 g/mole, less than 40,000 g/mole, or less than 30,000 g/mole. The modifying polymer may have even a lower molecular provided that the modifying polymer is a solid at ambient temperature.

Suitable thermoplastic modifying polymers include acrylic resin(s), polyvinyl resin(s), polyester(s), polyacrylate(s), polyurethane(s) and mixtures thereof. Polyvinyl resins include copolymers and terpolymers, such as available from Union Carbide Corp., a subsidiary of The Dow Chemical Company ("Dow"), Midland Mich. under the trade designation "UCAR". Polyester resins include copolyester resins commercially available from Bostik Inc., Middleton, Mass. under the trade designation "Vitel"; copolyester resins available from Eastman Chemical, Kingsport, Tenn. under the trade designation "Eastar" as well as other polyester resins available from Bayer, Pittsburg, Pa. under the trade designations "Multron" and "Desmophen"; Spectrum Alkyd & Resins Ltd., Mumbia, Maharshtra, India under the trade designation "Spectraalkyd" and Akzo Nobel, Chicago, Ill. under the trade designation "Setalin" alkyd.

The thermal transfer compositions of the invention have a softening or melting temperature low enough to permit quick, complete transfer under high-speed production conditions, yet high enough to avoid softening or blocking during routine storage, such as storage as a roll good. In some embodiments the thermally transferable composition has a softening or melting temperature of at least about 50° C., 60° C., or 70° C. Further the softening or melting temperature is typically less than 140° C., 130° C., or 120° C.

The thermal mass transferred compositions described herein comprise one or more coloring agents such as organic or inorganic pigments or dyes. If desired, the color agents may be fluorescent.

Typically to be useful in a retroreflective application, the colorant is transparent so the color is similar when viewed under either ordinary diffuse light conditions (e.g., under daylight) or under retroreflective conditions (e.g., at night time when illuminated by vehicle headlights). This typically requires pigments with a relatively narrow absorption band to yield a saturated color and pigment particles with an average refractive index of about 1.5 and an average diameter less than 1 micron in order to minimize light scattering. It is also preferred that the particle have an index of refraction that is close to that of the surrounding matrix so as to make any discontinuity less visible. It is especially preferred when organic pigments are used that such pigments be of small particle size so as to minimize light scattering as light passes through the color layer. Dyes also reduce light scattering but generally exhibit a greater tendency to migrate in these materials and therefore are more suitable for applications with shorter lifetimes.

Illustrative examples of suitable organic pigments include phthalocyanines, anthraquinones, perylenes, carbazoles, monoazo- and diazobenzimidazolone, isoindolinones, monoazonaphthol, diarylidepyrazolone, rhodamine, indigoid, quinacridone, disazopyranthrone, dinitraniline, pyrazolone, dianisidine, pyranthrone, tetrachloroisoindolinone, dioxazine, monoazoacrylide, anthrapyrimidine. It will be recognized by those skilled in the art that organic pigments may be differently shaded, or even differently colored, depending on the functional groups attached to the main molecule. However, many of the listed organic pigments have exhibited good weatherability in simulated outdoor use in that they retain much of their initial brightness and color, as exemplified herein below.

Commercial examples of useful organic pigments include those known under the trade designations PB 1, PB 15, PB 15:1, PB 15:2, PB 15:3, PB 15:4, PB 15:6, PB 16, PB 24, and PB 60 (blue pigments); PB 5, PB 23, and PB 25 (brown pigments); PY 3, PY 14, PY 16, PY 17, PY24, PY65, PY73, PY74, PY83, PY95, PY97, PY 108, PY 109, PY 110, PY 113, PY 128, PY 129, PY 138, PY 139, PY 150, PY 154, PY 156, and PY 175 (yellow pigments); PG 1, PG 7, PG 10, and PG 36 (green pigments); PO 5, PO 15, PO 16, PO 31, PO 34, PO 36, PO 43, PO 48, PO 51, PO 60, and PO 61 (orange pigments); PR 4, PR 5, PR 7, PR 9, PR 22, PR 23, PR 48, PR 48:2, PR 49, PR 112, PR 122, PR 123, PR149, PR 166, PR 168, PR 170, PR 177, PR 179, PR 190, PR 202, PR 206, PR 207, and PR 224 (red); PV 19, PV 23, PV 37, PV 32, and PV 42 (violet pigments).

Pigments can be made dispersible in a diluent (e.g. organic solvent) by milling the particles with a polymeric binder or by milling and surface treating the particle with suitable polymeric surfactant.

To enhance durability of the imaged substrate, especially in outdoor environments exposed to sunlight, a variety of commercially available stabilizing chemicals can be added optionally to the primer compositions. These stabilizers can be grouped into the following categories: heat stabilizers, UV light stabilizers, and free-radical scavengers.

Heat stabilizers are commonly used to protect the resulting image graphic against the effects of heat and are commercially available from Witco Corp., Greenwich, Conn. under the trade designation "Mark V 1923" and Ferro Corp., Polymer Additives Div., Walton Hills, Ohio under the trade designations "Synpron 1163", "Ferro 1237" and "Ferro 1720". Such heat stabilizers can be present in amounts ranging from about 0.02 to about 0.15 weight percent.

Ultraviolet light stabilizers can be present in amounts ranging from about 0.1 to about 5 weight percent of the total primer or ink. UV-absorbers are commercially available from BASF Corp., Parsippany, N.J. under the trade designation "Uvinol 400"; Cytec Industries, West Patterson, N.J. under the trade designation "Cyasorb UV 1164" and Ciba Specialty Chemicals, Tarrytown, N.Y., under the trade designations "Tinuvin 900" "Tinuvin 123" and "Tinuvin 1130".

Free-radical scavengers can be present in an amount from about 0.05 to about 0.25 weight percent of the total primer composition. Nonlimiting examples of free-radical scavengers include hindered amine light stabilizer (HALS) compounds, hydroxylamines, sterically hindered phenols, and the like.

HALS compounds are commercially available from Ciba Specialty Chemicals under the trade designation "Tinuvin 292" and Cytec Industries under the trade designation "Cyasorb UV3581".

In the preparation of a thermal mass transfer ribbon, thermal transfer composition is typically dispersed in a non-aqueous solvent and coated onto a carrier. In general, organic solvents tend to dry more readily and thus are preferred for making thermal mass transfer ribbons from such compositions. As used herein, "organic solvent" refers to liquid having a solubility parameter greater than 7 $(cal/cm^3)^{1/2}$. Further, organic solvents typically have a boiling point of less than 250° C. and a vapor pressure of greater than 5 mm of mercury at 200° F. (93° C).

The solvent may be a single solvent or a blend of solvents. Suitable solvents include alcohols such as mineral spirits, isopropyl alcohol (IPA) or ethanol; ketones such as methyl ethyl ketone (MEK), methyl isobutyl ketone (MIBK), diisobutyl ketone (DIBK); cyclohexanone, or acetone; aromatic hydrocarbons such as toluene and xylene; isophorone; butyrolactone; N-methylpyrrolidone; tetrahydrofuran; esters such as lactates, acetates, including propylene glycol monomethyl ether acetate such as commercially available from 3M under the trade designation "3M Scotchcal Thinner CGS10" ("CGS10"), 2-butoxyethyl acetate such as commercially available from 3M under the trade designation "3M Scotchcal Thinner CGS50"("CGS50"), diethylene glycol ethyl ether acetate (DE acetate), ethylene glycol butyl ether acetate (EB acetate), dipropylene glycol monomethyl ether acetate (DPMA), iso-alkyl esters such as isohexyl acetate, isoheptyl acetate, isooctyl acetate, isononyl acetate, isodecyl acetate, isododecyl acetate, isotridecyl acetate or other iso-alkyl esters; combinations of these and the like.

The solvent-based coating composition preferably contains at least 5 wt-% solids, at least 10 wt-% solids, or at least 15 wt-% solids of the thermal mass transfer composition. Typically the solvent-based coating composition comprises no more than 50 wt-% solids, more typically less than 40 wt-% solids are more typically less than 30 wt-% solids of the thermal mass transfer composition.

Thermal transfer ribbon articles may be formed by coating the solvent-based composition using any suitable coating method including (e.g. imprint) gravure, roll coating, bar coating, or knife coating, onto a carrier support and drying the mixture at room temperature. For gravure coating, the solvent-based coating composition typically has a viscosity ranging from about 20 to about 1000 cps. In the case of knife coating and bar coating, however, the viscosity may range as high as 20,000 cps.

The thermal transfer composition is normally retained on a carrier support prior to thermal transfer. The carrier support can include a sheet, film ribbon, or other structure. The carrier film is typically from about 1 to about 10 microns thick, and more typically from about 2 to 6 microns thick. An optional anti-stick/release coating can be coated onto the side of the carrier film not having the thermally transferable composition. Anti-stick release coatings improve handling characteristics of the articles. Suitable anti-stick release materials include, but are not limited to, silicone materials including poly(lower alkyl)siloxanes such as polydimethylsiloxane and silicone-urea copolymers, and perfluorinated compounds such as perfluoropolyethers. In some instances an optional release liner may be provided over the thermally transferable composition to protect it during handling, etc.

Suitable carrier film materials for thermal transfer articles of the invention provide a means for handling the thermal transfer article and are preferably sufficiently heat resistant to remain dimensionally stable (i.e., substantially without shrinking, curling, or stretching) when heated to a sufficiently high temperature to achieve adherence of the adherence layer to the desired substrate. Also, the carrier film preferably provides desired adhesion to the thermally transferable composition during shipping and handling as well as desired release properties from the thermally transferable composition after contact to the substrate and heating. Finally, the carrier and other components of the article preferably exhibit sufficient thermal conductivity such that heat applied in an imagewise fashion will heat a suitable region of the color layer in order to transfer a graphic pattern of desired resolution. Suitable carriers may be smooth or rough, transparent or opaque, and continuous (or sheet-like). The carriers are preferably essentially non-porous. By "non-porous" it is meant that ink, paints and other liquid coloring media or anti-stick compositions will not readily flow through the carrier (e.g., less than 0.05 milliliter per second at 7 torr applied vacuum, preferably less than 0.02 milliliter per second at 7 torr applied vacuum).

Illustrative examples of materials that are suitable for use as a carrier include polyesters, especially polyethylene terepthalate (PET) commercially available from E.I DuPont Demours company under the trade designation "Mylar", polyethylene naphthalate, polysulfones, polystyrenes, polycarbonates, polyimides, polyamides, cellulose esters, such as cellulose acetate and cellulose butyrate, polyvinyl chlorides and derivatives, aluminum foil, coated papers, and the like. The carrier generally has a thickness of 1 to 500 micrometers, preferably 2 to 100 micrometers, more preferably 3 to 10 micrometers. Particularly preferred carriers are white-filled or transparent PET or opaque paper. The carrier film should be able to withstand the temperature encountered during application. For instance, Mylar polyester films are useful for application temperatures under 200° C. with other polyester films being preferred for use at higher temperatures.

The ribbon can be employed with various commercially available thermal mass transfer printers. An example of a representative thermal mass transfer printer is manufactured by Matan Digital Printers Ltd. under the trade designation "Matan Spring12 Thermal Transfer Printer."

EXAMPLES

The chemical composition, molecular weight, and Tg of various unreactive thermoplastic acrylic resin that may be used in the preparation of thermal mass transferable compositions is set for the in Table 1 as follows:

TABLE 1

| Trade Name | Chemical Composition | Molecular Weight (Mw) G/mole | Tg (° C.) |
|---|---|---|---|
| "Paraloid A-11" | PMMA | 125,000 | 100 |
| "Paraloid A-14" | PMMA | 90,000 | 95 |
| "Paraloid A-21" | PMMA | 120,000 | 105 |
| "Paraloid B-44" | MMA/EA | 140,000 | 60 |
| "Paraloid B-60" | MMA/BMA | 50,000 | 75 |
| "Elvacite 2010" | PMMA | 84,000 | 98 |
| "Elvacite 2021" | MMA/EA 95-5 | 119,000 | 100 |
| "Elvacite 2044" | n-BMA | 140,000 | 15 |
| "Elvacite 2046" | n-BMA/IBMA | 165,000 | 35 |
| "Elvacite 4028" | MMA | 108,000 | 85 |

Representative thermal mass transferable compositions are depicted in Table 2 as follows:

TABLE 2

| Acrylic Resin | Acrylic Resin Concentration | VAGH Concentration | Pigment Green 7 |
|---|---|---|---|
| "Paraloid A-11" | 40 wt-% | 30 wt-% | 30 wt-% |
| "Paraloid A-14" | 40 wt-% | 30 wt-% | 30 wt-% |
| "Paraloid A-21" | 40 wt-% | 30 wt-% | 30 wt-% |
| "Paraloid B-44" | 55 wt-% | 15 wt-% | 30 wt-% |
| "Paraloid B-60" | 50 wt-% | 20 wt-% | 30 wt-% |
| "Elvacite 2010" | 40 wt-% | 30 wt-% | 30 wt-% |
| "Elvacite 2021" | 40 wt-% | 30 wt-% | 30 wt-% |
| "Elvacite 2044" | 70 wt-% | | 30 wt-% |

TABLE 2-continued

| Acrylic Resin | Acrylic Resin Concentration | VAGH Concentration | Pigment Green 7 |
|---|---|---|---|
| "Elvacite 2046" | 70 wt-% | | 30 wt-% |
| "Elvacite 4028" | 50 wt-% | 15 wt-% | 30 wt-% |

Several techniques may be used to disperse pigments into a polymer matrix to a size of less than 1 micrometer. These techniques include media milling, ball milling, and roll milling. The compositions of Table 2 can then be prepared into 25-30 wt-% solids ink 10 in solvent through mixing techniques such as paddle mixing. The compositions can then be coated onto polyester film by use of a wire wound bar and dried at a thickness of about 1 to 3 microns. The resulting coated carrier film can be spliced into a commercially available thermal mass transfer ribbon for use in a commercially available thermal mass transfer imaging device such as a Zebra 170 Xi.

The ribbons can be used to image retroreflective sheeting such as commercially available from 3M.

A thermal mass transfer ribbon ("3M Ribbon") suitable for imaging retroreflective sheeting was evaluated and compared to a Prior Art Ribbon which has been sold for the thermal mass transfer of retroreflective sheeting for traffic signs. The 3M ribbon comprises about 70 wt-% acrylic resin in combination with a polyester resin and green colorant.

Both the 3M Ribbon and the Prior Art Ribbon were used to image a transparent acrylic top film used on retroreflective sheeting commercially available from 3M under the trade designation "3990 VIP Diamond Grade" with a Matan Spring12 Thermal Transfer Printer (6-station) using the following printing conditions:

Speed: 393 ft/hr
Energy: 46
Resolution: 400 Normal
Thickness of printed sample: 3-4 micrometers Transmittance measurements were made on a Perkin Elmer Lambda 900 Spectrophotometer fitted with a PELA 1000 integrating sphere accessory. This sphere is 150 mm (6 inches) in diameter and complies with ASTM methods E903, D1003, E308, et al. as published in "ASTM Standards on Color and Appearance Measurement", Third Edition, ASTM, 1991

Spectra were obtained from 300-700 nm, with a data increment of 1 nm, integration time 0.56 s. The spectrophotometer was calibrated 100% with a standard white plate in place, and no sample in the holder. For sample measurements, the film was placed in the holder with the printed side toward the incident light. The detector arrangements are described below in the results section. Two areas of each printing (3M and Prior Art) were sampled. The duplicate cuts provided the same spectra, only one is shown below. Reversing the direction of the sample (printed side not toward the incident light) had no effect on the spectra.

Figure 3:
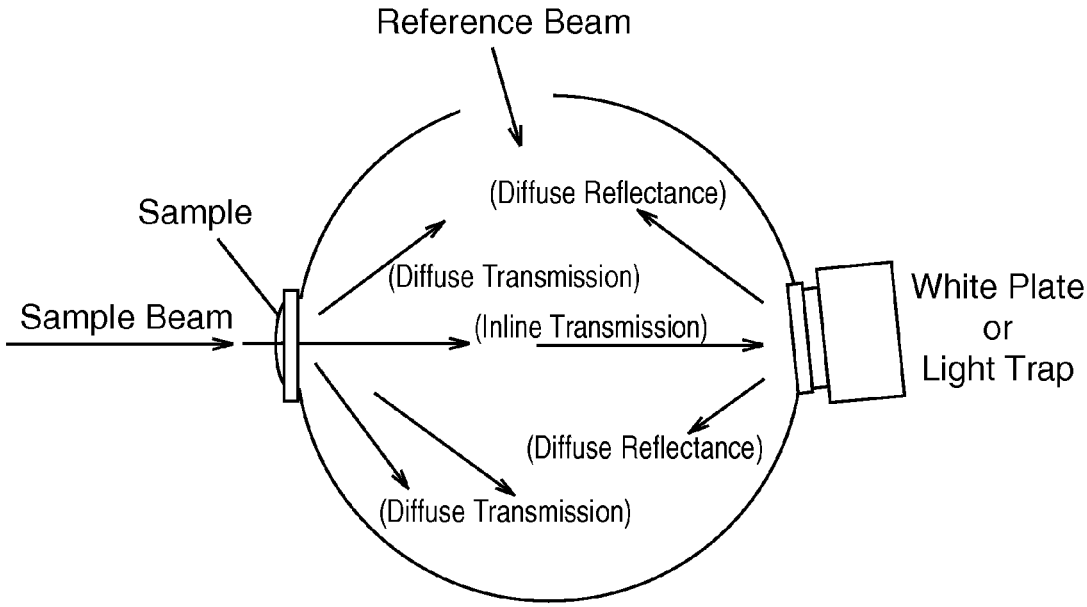
FIG. 3 is a diagram of the measurement of total luminous transmittance and diffuse luminous transmittance.
Figure 4:
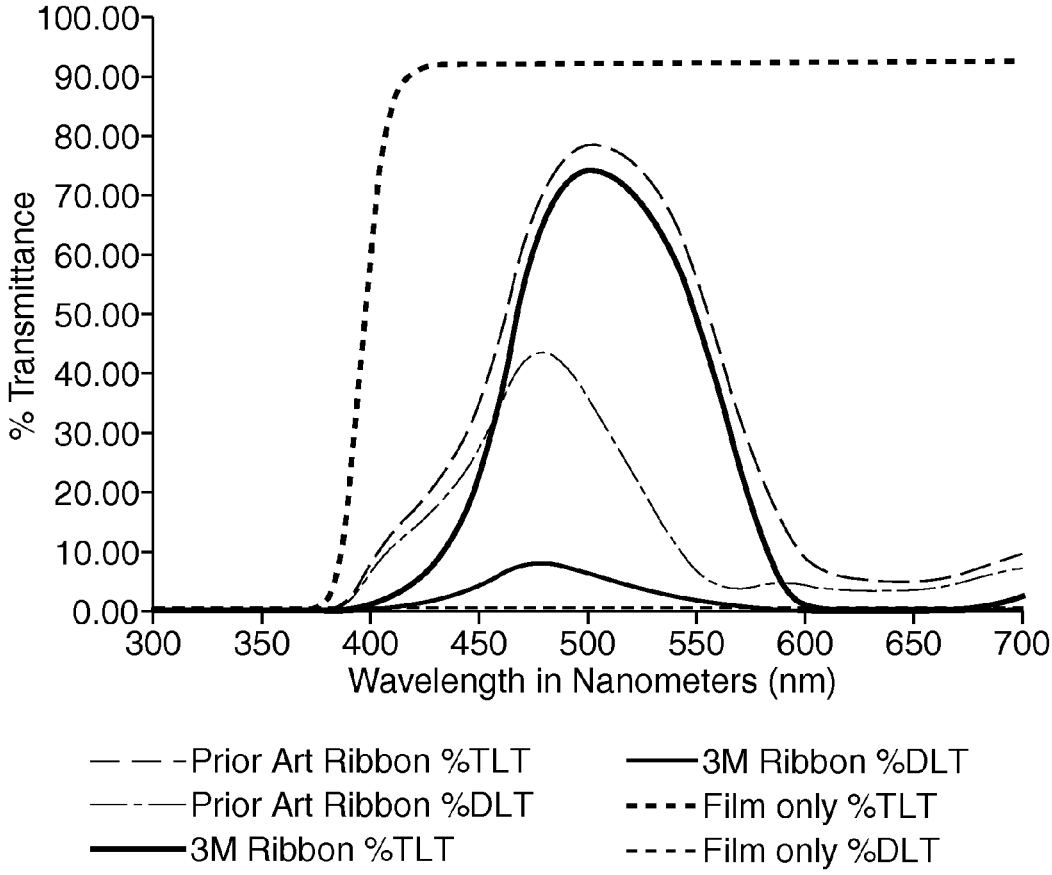
FIG. 4 is a plot of total transmittance and diffuse transmittance of a thermal mass transfer imaged transparent film.

The Total Luminous Transmittance (TLT) and Diffuse Luminous Transmittance (DLT) at normal incidence was measured. Depolarized light was used for these measurements—achieved via the common beam depolarizer in the instrument. The DLT data were measured with a high efficiency light trap behind the samples (See FIG. 3).

Total Luminous Transmittance:

Since the sample was placed before an integrating sphere, it is possible to capture all the light that is transmitted through the sample. This measurement is called Total Luminous Transmittance (TLT). Factors affecting the TLT include: any reflections at the surfaces of the sample (air/sample, sample/air), absorption of light by the sample, and scattering of light back in the direction from which it came.

The clear (i.e. unimaged) film shows a 93% transmittance, which is expected due to reflections at the interfaces of the film. The UV cutoff of the film was at approximately 420 nm. The image printed with the 3M Ribbon exhibited a slightly lower TLT than the Prior Art Ribbon, 74% vs. 78% at the maximum transmission wavelength of 500 nm. This could be because of a thicker 3M film, a more strongly absorbing 3M colorant, or differing surface roughness qualities affecting reflection/scattering in the incident direction. Also, the 3M printing completely blocks transmission above 600 nm, whereas the Prior Art printing still allows about 5-10% transmittance.

Diffuse Transmittance:

The diffuse luminous transmittance (DLT) is a measurement of how much of the total transmittance is scattered at angles, rather than being transmitted in a straight line through the sample. To measure this, an empty black cylinder (trap) is place in the direct transmission line on the opposite side of the integrating sphere from the sample. Light transmitted straight through the sample is "trapped", and not measured. Only light that is "scattered" at other angles is captured by the integrating sphere.

The clear (i.e. unimaged) film shows little or no DLT, indicating that none of the observed scattering by the samples is due to the substrate film itself. The Prior Art Ribbon shows a markedly higher level of DLT than the 3M Ribbon, 43% vs. 7% at the maximum DLT wavelength of 477 nm. This data shows that the 3M printing has a much more "transparent" nature than the Prior Art printing. The higher scattering of the Prior Art Ribbon induces a "translucence" effect.

In comparing the 3M material to Prior Art it may be useful to calculate the percent DLT at maximum transmittance to TLT at maximum transmittance (% $DLT_{max}$/% $TLT_{max}$ multiplied by 100). This characterizes the fraction of transmitted light scattered at that wavelength as reported in the table below:

| Prior Art Ribbon % TLT max @ 503 nm | Prior Art Ribbon % DLT max @ 480 nm | 3M Ribbon % TLT max @ 503 nm | 3M Ribbon % DLT max @ 478 nm |
|---|---|---|---|
| 78.37% | 43.43% | 74.07% | 8.10% |
| $DLT_{max}/TLT_{max}$ = | 55.42% | $DLT_{max}/TLT_{max}$ = | 10.94% |

The thermal mass transferable compositions of Table 2 are believed to have similar total luminous transmittance and diffuse luminous transmittance as the 3M Ribbon since such compositions are free of (light scattering) opaque components such as filler and wax.

Retroreflective traffic signage sheeting commercially available from 3M under the trade designation "3290 Engineer Grade and "3930 High Intensity Prismatic" were thermal mass transfer printed with the green 3M Ribbon and a blue and red thermal mass transfer ribbon believed to have similar total luminous transmittance and diffuse luminous transmittance as the green 3M ribbon. The printing conditions were as follows

| | | |
|---|---|---|
| 3290 Engineer Grade | Resolution: | 400 × 800 Normal |
| | Energy: | 51 |
| 3930 High Intensity Prismatic | Resolution: | 400 × 400 Normal |
| | Energy: | 51 for Red<br>56 for Blue and Green |

The gloss, brightness, and color were measured according to the following test methods:

Gloss

The gloss was measured at a 60° geometry with an instrument available from BYK Gardner under the trade designation "Micro-TRI-Gloss"

Initial Brightness and Brightness Retention

The brightness was measured with a retroluminometer as described in U.S. Defensive Publication T987,003 at an observation angle of 0.2° and an entrance angle of −4.0°.

Color

The color was measured with a HunterLab LabScan XE with a 0/45 geometry, D65/2° observation angle using a Yxy colorscale, an area view of 1.00 inches and a port size of 1.2 inches.

The results are reported in Table 3 as follows:

TABLE 3

| | | 60 degree | | Color | | |
|---|---|---|---|---|---|---|
| Sample | Sheeting | gloss | Brightness (−4/0.2) | Y | x | Y |
| TTR2308 Green | 3290 Engineer Grade | 65.5 | 15.4 | 9.5 | 0.1356 | 0.4209 |
| | 3930 High Intensity Prismatic | 79.5 | 69 | 6.93 | 0.1307 | 0.3977 |
| TTR2312 Red | 3290 Engineer Grade | 73.7 | 18.2 | 6.15 | 0.6494 | 0.3218 |
| | 3930 High Intensity Prismatic | 104.7 | 92.7 | 5.17 | 0.6492 | 0.3207 |
| TTR2303 Blue | 3290 Engineer Grade | 62.2 | 10.4 | 5.11 | 0.1405 | 0.1148 |
| | 3930 High Intensity Prismatic | 79 | 42.9 | 4.03 | 0.1424 | 0.1091 |

The thermal mass transferable compositions of Table 2 are believed to provide similar gloss, brightness, and color.

Additional samples of retroreflective sheeting were thermal mass transfer printed as follows:

On 3290 Engineer Grade, printing was accomplished as follows:

Matan Spring12 Thermal Transfer Printer
Resolution: 400×800
Energy: 18 (blue and green), 16 (red)
Speed: 289 ft/hr (blue and green), 305 ft/hr (red)
Printhead preheated to 27° C.

On 3930 High Intensity Prismatic, printing was accomplished as follows:

Matan Spring12 Thermal Transfer Printer
Resolution: 400×200
Energy: 35 (red and green), 40 (blue)
Speed: 820 ft/hr (red and green), 741 ft/hr (blue)
Printhead preheated to 27° C.

The sheeting was subjected to outdoor weather testing as described in ASTM Practice G7. The gloss, retroreflected brightness retention, and color were measured as previously described.

The results are reported in Tables 4 and 5 as follows

TABLE 4

| | | Florida | | | | | |
|---|---|---|---|---|---|---|---|
| | | Time exposed | % gloss | % brightness | Color | | |
| Sample | Sheeting used | — | retention | retention | Y | x | y |
| TTR2308 Green | 3290 Engineer Grade | 12 months | 91 | 124 | 8.68 | 0.1439 | 0.4237 |
| | 3930 High Intensity Prismatic | 9 months | 100 | 106 | 6.59 | 0.141 | 0.4041 |
| TTR2312 Red | 3290 Engineer Grade | 12 months | 82 | 89 | 7.95 | 0.5973 | 0.3348 |
| | 3930 High Intensity Prismatic | 9 months | 88 | 82 | 6.18 | 0.6087 | 0.33 |
| TTR2303 Blue | 3290 Engineer Grade | 12 months | 66 | 117 | 6.8 | 0.1522 | 0.1378 |
| | 3930 High Intensity Prismatic | 9 months | 86 | 112 | 5.21 | 0.1526 | 0.1264 |

TABLE 5

| | | Arizona | | | | | |
|---|---|---|---|---|---|---|---|
| | | Time | % gloss | % brightness | Color | | |
| Sample | Sheeting used | exposed | retention | retention | Y | x | y |
| TTR2308 Green | 3290 Engineer Grade | 10 months | 92 | 124 | 8.34 | 0.1404 | 0.4251 |
| | 3930 High Intensity Prismatic | 9 months | 98 | 106 | 6.71 | 0.14 | 0.4074 |
| TTR2312 Red | 3290 Engineer Grade | 10 months | 82 | 88 | 7.17 | 0.6101 | 0.3311 |
| | 3930 High Intensity Prismatic | 9 months | 93 | 105 | 8.18 | 0.5783 | 0.3389 |
| TTR2303 Blue | 3290 Engineer Grade | 10 months | 82 | 112 | 5.53 | 0.1468 | 0.1268 |
| | 3930 High Intensity Prismatic | 9 months | 99 | 106 | 4.39 | 0.1491 | 0.1187 |

The thermal mass transferable compositions of Table 2 are believed to provide similar gloss, brightness, and color retention.

What is claimed is:

1. A retroreflective sheeting comprising a viewing surface and a non-viewing surface and a thermal mass transferred image disposed in the optical path of the viewing surface wherein the thermal mass transferred image comprises a homogeneous unreactive thermoplastic composition comprising at least one acrylic resin and at least one colorant, wherein the composition has less than 3 wt-% of components that are opaque at ambient temperature.

2. The retroreflective sheeting of claim 1 wherein the composition comprises less than 3 wt-% of material selected from inorganic fillers, waxes, and combinations thereof.

3. The retroreflective sheeting of claim 1 wherein the composition has a percent maximum diffuse luminous transmittance to total luminous transmittance of less than 50%.

4. The retroreflective sheeting of claim 1 wherein the composition has a percent maximum diffuse luminous transmittance to total luminous transmittance of less than 40%.

5. The retroreflective sheeting of claim 1 wherein the composition has a percent maximum diffuse luminous transmittance to total luminous transmittance of less than 30%.

6. The retroreflective sheeting of claim 1 wherein the composition has a percent maximum diffuse luminous transmittance to total luminous transmittance of less than 20%.

7. The retroreflective sheeting of claim 1 wherein the thermoplastic composition is free of wax.

8. The retroreflective sheeting of claim 1 wherein the colorant is a pigment.

9. The retroreflective sheeting of claim 1 wherein the thermal transferred image is provided on an exposed surface of an optically complete retroreflective sheeting.

10. The retroreflective sheeting of claim 1 wherein the thermal transferred image is provided between the retroreflective sheeting and a topfilm.

11. The retroreflective sheeting of claim 1 wherein the unreactive thermoplastic composition comprises at least 50 wt-% of one or more acrylic resins.

12. The retroreflective sheeting of claim 11 wherein at least one of the acrylic resins comprises has a weight average molecular weight of at least 80,000 g/mole.

13. The retroreflective sheeting of claim 11 wherein the unreactive thermoplastic composition comprises up to about 30 wt-% of a second modifying polymer.

14. The retroreflective sheeting of claims 13 wherein the modifying polymer selected from an acrylic resin, a polyvinyl resin, a polyester, a polyurethane, and mixtures thereof.

15. A retroreflective sheeting comprising a viewing surface and a non-viewing surface and a thermal mass transferred image disposed in the optical path of the viewing surface wherein the thermal mass transferred image comprises a homogeneous thermoplastic composition comprising at least 50 wt-% of one or more unreactive acrylic resins, optionally up to about 30 wt-% of a second thermoplastic resin, and a colorant.

16. The retroreflective sheeting of claim 15 wherein the second thermoplastic resin is selected from an acrylic resin, a polyvinyl resin, a polyester, a polyurethane, and mixtures thereof.

17. The retroreflective sheeting of claim 15 wherein the second thermoplastic resin in polyvinyl.

18. A retroreflective sheeting comprising a viewing surface and a non-viewing surface and a thermal mass transferred image disposed in the optical path of the viewing surface wherein the thermal mass transferred image comprises a homogeneous unreactive thermoplastic composition comprising at least one acrylic resin having a weight average molecular weight of at least 80,000 g/mole and a colorant.

19. A method of imaging retroreflective sheeting comprising:

providing retroreflective sheeting comprising a viewing surface and a non-viewing surface;

thermal mass transfer imaging the viewing surface of the sheeting or a topfilm that is bonded to the retroreflective sheeting with a thermoplastic composition selected from a) a homogeneous unreactive thermoplastic composition comprising at least one acrylic resin and at least one colorant, wherein the composition has less than 3 wt-% of components that are opaque at ambient temperature;

b) a thermoplastic composition comprising at least 50 wt-% of one or more unreactive acrylic resins, optionally up to about 30 wt-% of a second thermoplastic modifying resin, and a colorant; and c) an unreactive thermoplastic composition comprising at least one acrylic resin having a weight average molecular weight of at least 80,000 g/mole and a colorant.

* * * * *

UNITED STATES PATENT AND TRADEMARK OFFICE

CERTIFICATE OF CORRECTION

PATENT NO. : 7,727,617 B2
APPLICATION NO. : 11/425615
DATED : June 1, 2010
INVENTOR(S) : Jennifer Lynn Lee et al.

It is certified that error appears in the above-identified patent and that said Letters Patent is hereby corrected as shown below:

Column 6
Line 40, delete "Chromotography" and insert -- Chromatography --, therefor.

Column 7
Line 66, delete "dinitraniline," and insert -- dinitroaniline, --, therefor.

Column 9
Line 46, delete "Anti-stick release" and insert -- Anti-stick/release --, therefor.
Line 47, delete "anti-stick release" and insert -- anti-stick/release --, therefor.

Column 10
Line 11, delete "terepthalate" and insert -- terephthalate --, therefor.

Column 11
Line 13, before "in" delete "10".

Column 17
Line 7, in Claim 14, delete "claims" and insert -- claim --, therefor.

Signed and Sealed this

Sixteenth Day of November, 2010

David J. Kappos

David J. Kappos
*Director of the United States Patent and Trademark Office*